US012708140B2

(12) United States Patent
Houser

(10) Patent No.: US 12,708,140 B2
(45) Date of Patent: Aug. 18, 2026

(54) ROCK INSERT FOR SMOKING OR VAPING

(71) Applicant: Clay Houser, Denver, CO (US)

(72) Inventor: Clay Houser, Denver, CO (US)

( * ) Notice: Subject to any disclaimer, the term of this patent is extended or adjusted under 35 U.S.C. 154(b) by 415 days.

(21) Appl. No.: 18/200,048

(22) Filed: May 22, 2023

(65) Prior Publication Data

US 2023/0292825 A1 Sep. 21, 2023

Related U.S. Application Data

(63) Continuation-in-part of application No. 17/529,412, filed on Nov. 18, 2021, now abandoned.

(60) Provisional application No. 63/117,209, filed on Nov. 23, 2020.

(51) Int. Cl.

| | |
|---|---|
| ***A24F 9/00*** | (2006.01) |
| ***A24F 5/06*** | (2006.01) |
| ***A24F 5/10*** | (2006.01) |
| ***A24F 42/10*** | (2020.01) |
| ***A24F 42/60*** | (2020.01) |

(52) U.S. Cl.

CPC ..... *A24F 9/00* (2013.01); *A24F 5/06* (2013.01); *A24F 5/10* (2013.01); *A24F 42/10* (2020.01); *A24F 42/60* (2020.01)

(58) Field of Classification Search

CPC ..... A24F 9/10; A24F 42/10; A24F 7/02

See application file for complete search history.

(56) References Cited

U.S. PATENT DOCUMENTS

| | | | |
|---|---|---|---|
| 607,601 | A | 7/1898 | Ferrata |
| 1,780,029 | A | 10/1930 | Milkie |
| 1,796,589 | A | 3/1931 | Fritz |

(Continued)

FOREIGN PATENT DOCUMENTS

| | | | |
|---|---|---|---|
| DE | 202020100390 | U1 | 2/2020 |
| EP | 2272387 | A1 | 1/2011 |

(Continued)

OTHER PUBLICATIONS

Vapman, "Vapman Operating Instructions", http://www.vapman.ch/en/operating_instructions, Oct. 19, 2013, 2 pages.

(Continued)

*Primary Examiner* — Michael H. Wilson
*Assistant Examiner* — Jennifer A Kessie

(57) ABSTRACT

A heating rock for use with smoking or vaping paraphernalia such as a smoking pipe. The heating rock includes a porous body having a hollow interior including first and second interior regions for holding smokable or vaping material, and a closed bottom. The porous body includes a plurality of pores, or vesicles having different shapes and dimensions that are randomly formed to absorb heat generated by an external heating source. The porous body effectively absorbs heat, and gradually and evenly distributes heat in a controlled manner to the smokable or vaping material to produce a gaseous vapor for human consumption. The heating rock is compatible for use with heat sensitive concentrates that can be heated slowly without burning or combusting quickly. In one embodiment, the heating rock includes a plurality of channels that each are formed within the porous body to allow air to circulate more effectively during use.

10 Claims, 9 Drawing Sheets

(56) References Cited

U.S. PATENT DOCUMENTS

| | | | | |
|---|---|---|---|---|
| 1,957,143 | A | 5/1934 | Erwin | |
| 1,986,730 | A | 1/1935 | Beresford | |
| 2,499,504 | A | 3/1950 | Hull | |
| 2,630,807 | A | 3/1953 | Null | |
| 2,708,936 | A | 5/1955 | Steere | |
| 3,223,091 | A | 12/1965 | Fassbender | |
| 3,593,722 | A * | 7/1971 | Witz | A24F 1/32 131/196 |
| 3,645,274 | A * | 2/1972 | Lebert | A24F 5/00 131/226 |
| 3,826,799 | A | 7/1974 | Waring | |
| 4,020,853 | A | 5/1977 | Nuttall | |
| 4,210,160 | A | 7/1980 | Wunsche | |
| 4,687,005 | A | 8/1987 | Moore | |
| 7,434,584 | B2 | 10/2008 | Steinberg | |
| 9,016,274 | B1 | 4/2015 | White | |
| 9,445,629 | B2 | 9/2016 | Steinberg | |
| D838,898 | S | 1/2019 | Qiu | |
| 10,264,817 | B2 | 4/2019 | Haun | |
| D868,367 | S | 11/2019 | Franzone et al. | |
| 10,694,781 | B2 | 6/2020 | Martin | |
| 2008/0029107 | A1 | 2/2008 | Ruff et al. | |
| 2009/0293892 | A1 | 12/2009 | Williams et al. | |

FOREIGN PATENT DOCUMENTS

| | | | |
|---|---|---|---|
| FR | 2565075 | A1 | 12/1985 |
| GB | 405545 | A | 2/1934 |
| WO | 2020160466 | A1 | 8/2020 |

OTHER PUBLICATIONS

Vaponic, "Vaponic Plus", http..plus.vaponic.com, Jul. 20, 2017, 5 pages.

Vaporgenie, "The VaporGenie: The worlds first vaporizing pipel" https://vaporgenie.com, Mar. 15, 2010, 2 pages.

* cited by examiner

ROCK INSERT FOR SMOKING OR VAPING

CROSS-REFERENCE

This application is a Continuation-In-Part (CIP) that claims priority to co-pending U.S. patent application Ser. No. 17/529,412, entitled, "Rock Insert for Smoking or Vaping", filed Nov. 18, 2021, which claims the benefit of U.S. Provisional Patent Application No. 63/117,209, filed on Nov. 23, 2020, titled, "Rock Insert for Vaping", the entire contents of which is hereby incorporated by reference in its entirety.

FIELD OF INVENTION

The present invention relates to accessories or devices associated with smoking or vaping practices, and more particularly, to a rock insert or heating rock adapted for use with smoking and/or vaping paraphernalia and devices. The rock insert or heating rock includes a porous body that absorbs heat generated by an external heating source for gradually heating smokable or vaping material held within an interior of the porous body to produce a gaseous vapor for human consumption.

BACKGROUND OF THE INVENTION

Smoking or vaping devices have been developed over the years for individuals to enjoy various brands of smokable or vaping materials. A wide selection of smokable or vaping materials has been introduced to solicit the interest of users who wish to experience alternative choices of flavors, strengths, and aroma. Such smokable or vaping materials may include for example, different types of flavored or essential oils, tobaccos, or herbal plants or extracts. A traditional device typically used for smoking a plant-based product such as tobacco includes the well-known tobacco pipe. The tobacco pipe generally includes a pipe bowl joined to a stem having a delivery channel and a mouthpiece for inhaling a gaseous vapor that is produced when igniting smokable material with an external heat source such as a butane lighter, or match. Over time, various efforts have been made to improve the style, use and operation of conventional tobacco pipes. For example, a number of different filters have been designed to filter the inhaled gaseous vapor, devices have been engineered to enhance the circulation of air within the pipe bowl to increase combustion of the smokable material, and insulation materials have been introduced to shield a user's hand from excess heat during use.

In an effort to attract consumers, overcome certain unpleasantries associated with traditional smoking, and economize on the construction and use of conventional smoking devices, manufactures have developed a variety of electronic vaping devices. Electronic vaping devices provide a compact, self-operating, all-in-one device that does not require an external heating source as needed with traditional smoking pipes and accommodates use with a variety of liquid concentrates having different flavors, or consistencies. Electronic vaping devices typically include an internal heating element electrically coupled to an enclosed power source such as a disposable or rechargeable battery, via a control switch, and a small chamber for removably receiving a receptacle filled with a liquid concentrate. Upon activating the control switch, the internal heating element is energized to heat the liquid concentrate through conduction of thermal energy elevating the temperature of the liquid concentrate to produce a gaseous vapor for inhaled human consumption.

Although traditional smoking pipes and electronic vaping devices offer particular advantages, such devices also have certain drawbacks. For example, smoking pipes a. tailored for use with smokable materials that comprise plant-based substances and cannot be employed for use with liquid concentrates. Electronic vaping devices typically include heating elements that are specifically designed to operate at certain temperatures, often producing excessive, high intensity heat in a very short period of time. Heat sensitive concentrates vaporize quickly when exposed to high temperatures thus preventing the vapor from being captured and delivered in a timely manner for human consumption. Concentrates that are exposed to high temperatures or prolonged heat often produce a vapor having a bitter taste, a lower potency level, and burns quickly. Another drawback is that many electronic vaping devices are tailored for use with liquid concentrates and are not compatible for use with solid or semi-solid smokable materials thus limiting the choice of smoking materials for users.

Accordingly, there is an established need for a solution to at least one of the aforementioned problems. There remains a need for a smoking or vaping accessory that includes a rock insert or heating rock adapted for use with traditional, existing smoking and/or vaping paraphernalia such as a smoking pipe for heating smokable or vaping material in a controlled manner to produce a gaseous vapor for human consumption without the risk of burning the smokable material too quickly during use. There also remains a need for a rock insert that is small, compact, easily transportable, and is constructed from an abundance of natural resources. There is also a need for a heating rock that includes a plurality of channels formed within the porous body of the heating rock to enhance the circulation of airflow and promote combustion of smoking or vaping materials stored within the hollow interior of the heating rock when used with smoking pipes having smaller pipe bowl dimensions.

SUMMARY OF THE INVENTION

An objective of the present invention is to provide a rock insert or heating rock that is adapted for use with a variety of different smoking or vaping paraphernalia and devices. The rock insert or heating rock is constructed from a natural resource such as volcanic rock having advantageous heating properties that effectively absorbs heat when exposed to an external heating source and gradually delivers the absorbed heat to smokable or vaping material provided within the rock insert to produce a gaseous vapor without burning or combusting the smokable or vaping material.

One embodiment of present invention provides a rock insert for use with smoking and/or vaping materials, said rock insert comprising: a porous body including an interior extending partially within a central region of the porous body, a top opening in communication with the interior, and a closed bottom, the interior including a first interior region having a first interior sidewall integral with an annular base, annular ledge, or circular ledge, and a second interior region formed through the annular base, annular ledge, or circular ledge and coincident with the first interior region, the second interior region including a second interior sidewall having a top peripheral edge and a closed base, the second interior region being smaller in size than the first interior region, and wherein the porous body is heatable by an external heating source to gradually distribute heat to a smokable or vaping material deposited within the interior to produce a gaseous vapor for human consumption.

In one aspect, the porous body comprises a cylindrical porous body having an outer diameter and height. The first interior region comprises a first diameter, and the second interior region comprises a second diameter, where the second diameter is smaller than the first diameter.

In one aspect, the porous body comprises a microporous, macroporous, cryptoporous, ultramicroporous, or mesoporous material. The porous body comprises any of volcanic rock, lava, scoria, basalt, andesite, rhyolite, dacite, latite, pumice, pyroclastic rock, sandstone, siltstone, mudstone, shale, granite, Trachytic obsidian, Trachyte, Andesitic glass, Syenite, Granodiorite, Quartz diorite, Rhyolitic obsidian, various tuffite, clay, glass, firerock, limestone, or any combination thereof. In another embodiment the porous body is constructed from material that regulates heat and absorbs liquid that is gradually heated. The porous body includes a plurality of pores and/or vesicles having different sizes, shapes, and depths that are randomly formed within the body of the rock insert. The plurality of pores and/or vesicles do not extend completely through the porous body. Each of the plurality of pores and/or vesicles penetrate partially within the porous body of the rock insert.

In another aspect, the rock insert further includes a porous cap that is removably attachable to the top opening of the porous body for closing the interior. The porous cap comprises a plurality of pores and/or vesicles similar to the porous body.

In still another aspect, the rock insert further includes an alternate interior that is formed within the closed bottom and includes an alternative sidewall integral with an alternate closed base where the alternate interior is formed opposite the interior. Smoking or vaping material of varying consistencies, or densities may be held in either the interior or alternate interior during use. In another aspect, the rock insert may include engagement or friction features formed integral with, or separately attached to, the outer surface of the porous body to help removably retain the rock insert within a designated recess, opening or orifice of a smoking or vaping paraphernalia. The engagement features may include for example, one or more spirals, ridges, protrusions or nubs, band, or O-ring having heat resistant properties.

In yet another embodiment there is provided a volcanic rock removably seated in a smoking or vaping paraphernalia, said volcanic rock comprising:

- a porous body including a top surface, a bottom surface opposite the top surface, a surrounding sidewall integral with the top surface and the bottom surface, and a hollow interior extending partially within the porous body defining a top opening and a closed bottom;
- at least two channels each partially formed within the surrounding sidewall, and extending between the top surface and the bottom surface of the porous body, each of the channels having a width and a depth, and spaced apart from each other a predetermined distance circumferentially around the porous body; and
- wherein the porous body is heatable by an external heating source to gradually distribute heat to a smokable or vaping material stored within the hollow interior of the porous body to produce a gaseous vapor for human consumption.

In one aspect, the at least two channels comprise at least four channels each partially formed within, and extending between the top surface and the bottom surface of the porous body, each of the channels having a predetermined width and depth, and spaced apart from each other a predetermined distance circumferentially around the porous body.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

Figure 1:
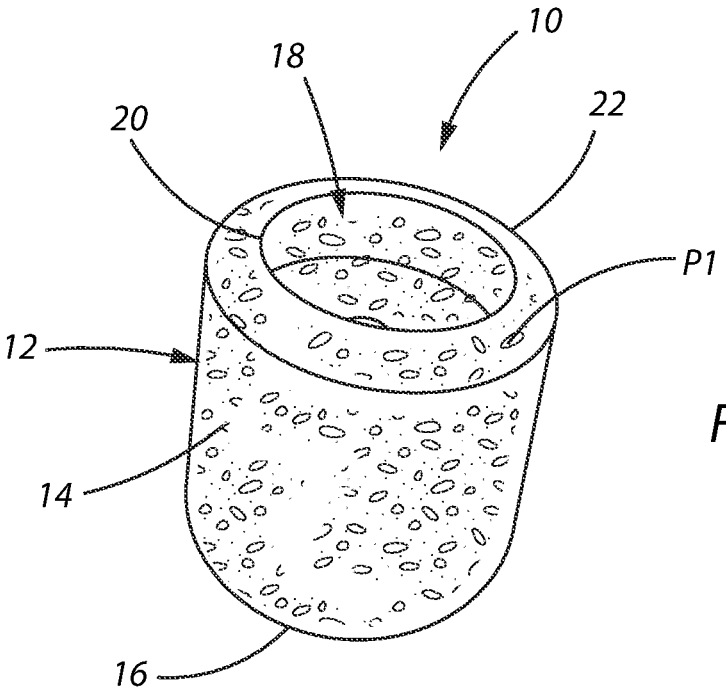
FIG. 1 is a top, perspective view of a rock insert including a porous body having a hollow interior extending within the porous body for holding a smokable or vaping material, a top opening in communication with the interior, and a closed bottom, in accordance with an embodiment of the present invention.

The following detailed description is merely exemplary in nature and is not intended to limit the described embodiments or the application and uses of the described embodiments. Terms and phrases used in this document, and variations thereof, unless otherwise expressly stated, should be construed as open ended as opposed to limiting. The term "including" should be read as meaning "including, without limitation" or the like; the terms "illustrative", "exemplary", or "example" is used to provide exemplary instances or illustrations of the item in discussion, and not an exhaustive or limiting list thereof, or not construed as preferred or advantageous over other implementations; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Furthermore, the use of plurals can also refer to the singular, including without limitation when a term refers to one or more of a particular item; likewise, the use of a singular term can also include the plural, unless the context dictates otherwise.

All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is understood that the specific devices and processes illustrated in the attached drawings, and described in the following specification, are simply exemplary embodiments of the inventive concepts defined in the appended claims. Hence, specific dimensions, exploded views, and other characteristics relating to the embodiments disclosed herein are not limiting, unless the claims expressly state otherwise.

The term, "smokable or vaping material" as used herein, refers to any compound, mixture, blend, concentrate, agent, powder, solid, semi-solid, wax, oil, gel, or liquid, comprising any of, tobacco, nicotine, herbs including, for example, mullein, skullcap, coltsfoot, mugwort, uva-ursi, mint, and sage, other plants or flowers including California poppy, hops, honeyweed, lavender, lily, passion flower, wireweed, natural or herbal teas, flavored oils, essential oils, blends of essential oils, infused waxes, hemp, extracts, *Cannabis sativa*, marijuana, *Cannabis indica*, or cannabidiol (CBD), or vaporizing flavors. The smoking or vaping material may also include medical agents or medical concentrates for use in medical applications associated with pulmonary function, nasal or sinus congestion, oral hygiene, stress management, depression, or pain management.

The term, "porous" as used herein includes a wide range of porous materials, including but not limited to, cryptoporous, ultramicroporous, microporous, mesoporous, macroporous, or having other pore sizes, but it also includes materials having a combination of different pore sizes. Porous also refers to a plurality of pores and/or vesicles having different sizes, shapes, and depths that are randomly formed within the body of the rock insert. The plurality of pores and/or vesicles do not extend completely through the porous body. Each of the plurality of pores and/or vesicles penetrate partially within the porous body of the rock insert, and any number of pores and/or vesicles may interconnect with each other.

Figure 2:
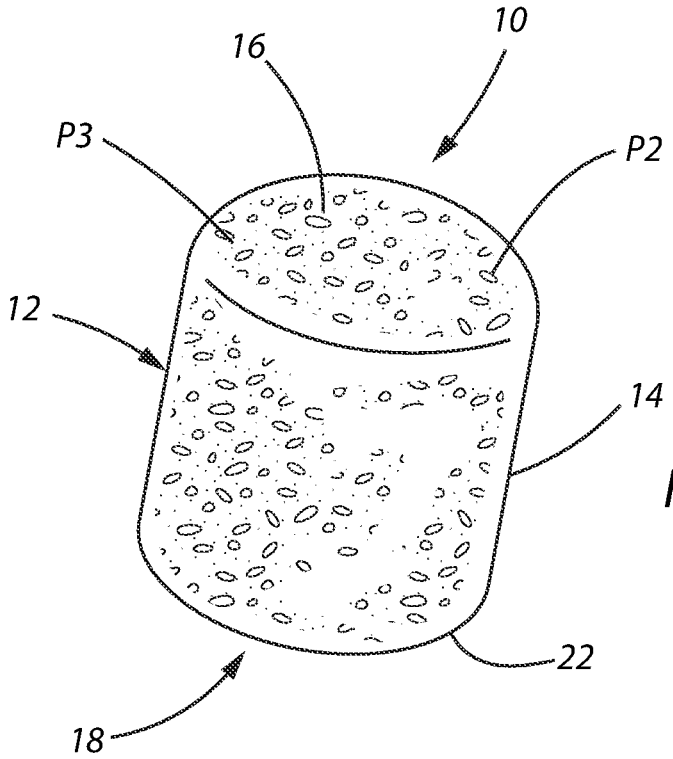
FIG. 2 is a bottom, perspective view of the rock insert of FIG. 1, showing the porous body including the closed bottom having a rounded contour.

Referring now to the figures wherein like elements are represented by like numerals throughout, there are shown in FIGS. 1 and 2, a top and bottom perspective view, respectively, of a rock insert, or heating rock 10 adapted for use with a variety of traditional or specifically constructed vaping and/or smoking paraphernalia, in accordance with one embodiment of the present invention. Reference made to vaping and/or smoking paraphernalia herein may include, but is not limited to, a smoking pipe, a tobacco pipe, a bong, an electronic vaporizer, an e-cigarette, or other device particularly constructed and engineered for heating smokable or vaping material to produce a gaseous smoke or vapor for human consumption. As such, rock insert 10 is adapted and configured for use with any smoking or vaping paraphernalia having a designated port, opening or recess to accommodate receiving the rock insert 10 therein.

The heating rock 10 includes a porous body 12 having a sidewall 14, a closed bottom 16, and a hollow interior or cavity 18 extending partially within the porous body 12 defining a top opening 20 including a top perimeter 22. In one embodiment, rock insert 10, and more particularly porous body 12 comprises an annular, or cylindrical body having a closed bottom 16 including a round or conical contour, as better illustrated in FIG. 2. It is appreciated that porous body 12 is formed and constructed from earth's natural resource material such as volcanic lava, extrusive and/or igneous substance or materials having a porous structure including a plurality of minute spaces, holes, pores, crevices, pockets, vesicles, cavities, and/or grain boundaries shown generally, for illustrative purposes, at P1, P2, and P3.

The porous structure of the body 12 includes heat resistance properties that provides natural heat insulation properties that effectively absorbs heat, and evenly distributes heat when heated by an external heat source such as an open flame. The porous structure of the body 12 continues to deliver heat gradually over a prescribed period of time even after an external heat source is extinguished or removed. The heat insulating properties of the porous body 12 operates to shield and protect a liquid concentrate material or agent, retained within the hollow interior 18 of the porous body 12 from burning quickly as a result of direct exposure to an open flame provided by an external heat source as often experienced in prior art devices. In some embodiments, the pores are interconnected and form porous networks through the porous body.

The porous body 12 is constructed from various types of materials including for example, but not limited to, volcanic rock or lava, extrusive and/or igneous materials, basalt, andesite, rhyolite, dacite, latite, pumice, pyroclastic rock, sandstone, siltstone, mudstone, shale, granite, Trachytic obsidian, Trachyte, Andesitic glass, Syenite, Granodiorite, Quartz diorite, Rhyolitic obsidian, various tuffite, clay, glass, fire rock, limestone, or any combination thereof. Red lava rock, technically called "scoria" provides a colorful addition to the rock insert 10 and comprises vesicular basaltic lava having very small pores or vesicles (<1 mm). Grey lava rock often referred to as "pumice" typically includes subtle layering of a volcanic glassy nature that comprises a mixture of rock and volcanic ash and includes an abundance of air thus being extremely light in weight. Red lava rock is generally denser in nature as it has less air infused into the rock as compared to pumice. In a preferred embodiment, the rock insert 10 is constructed using the more dense red lava rock.

Figure 5:
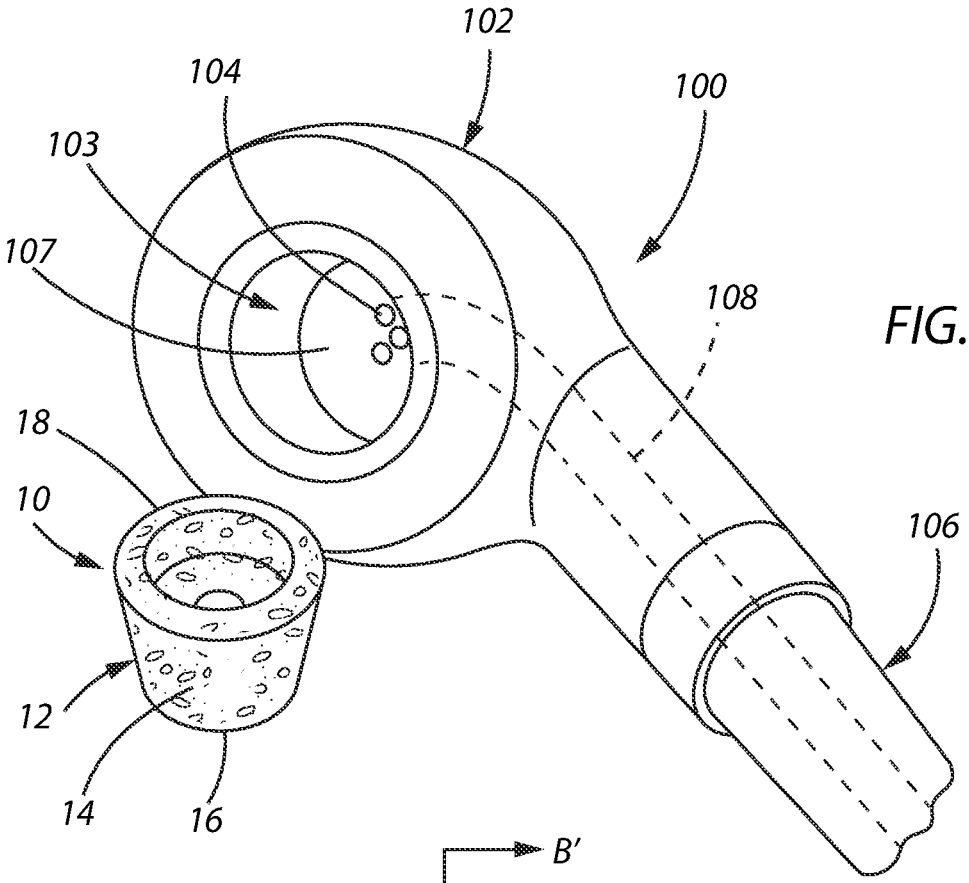
FIG. 5 is a perspective view of the rock insert of FIG. 1, and a partial view of a vaping or smoking paraphernalia comprising a smoking pipe including a pipe bowl joined to a stem including a delivery channel shown in broken lines.
Figure 6:
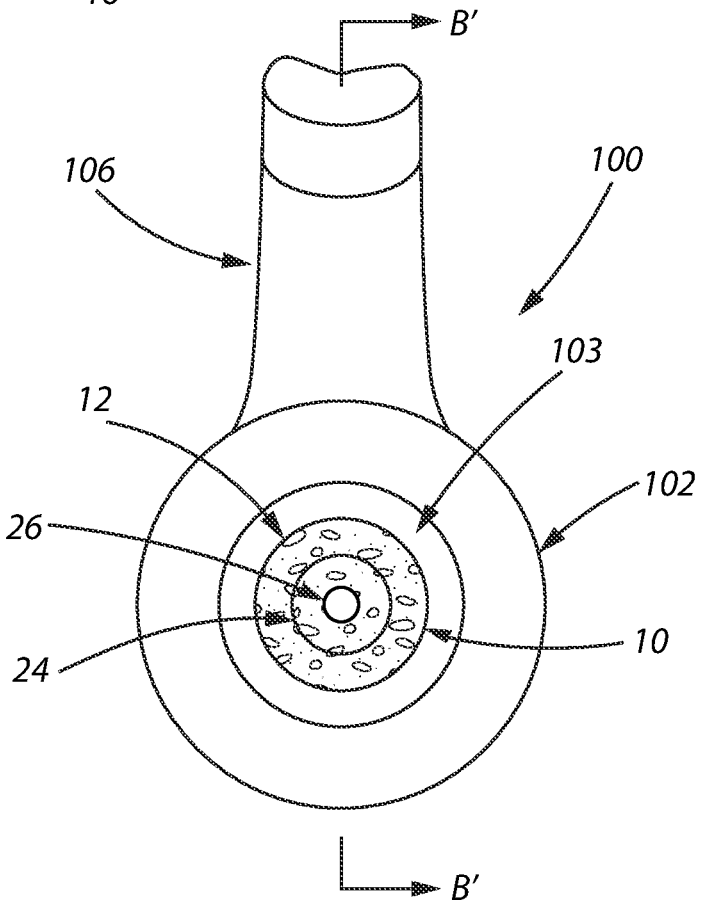
FIG. 6 is a top view of the rock insert of FIG. 1, and the pipe bowl of the smoking pipe of FIG. 5, showing the rock insert removably inserted within the pipe bowl providing viewable access to the hollow interior of the rock insert.

With reference made to FIG. 2, the heating rock 10 of FIG. 1 is shown inverted to illustrate the feature of the closed bottom 16 having a rounded contour, or a conical shape that is sized and shaped to facilitate inserting the rock insert 10 within a designated recess or opening of a smoking or vaping paraphernalia such as for example, a pipe bowl 102 of a smoking pipe 100, as better illustrated in FIG. 6. It is noted that the porous body 12 may comprise any shape and size produced by tooling machines or instruments to accommodate inserting the rock insert 10 within a designated recess or opening of a smoking or vaping paraphernalia device. For example, the rock insert 10 may be fabricated or constructed by a tumbling process to give it a desired shape. As such, the rock insert 10 may comprise any number of different sizes, diameters or shapes to accommodate use with various types of smoking or vaping paraphernalia. In one alternative example, the porous body 12 may comprise a square shape to accommodate fitting into a square recess of a smoking device. In the preferred embodiment, the rounded contour of the closed bottom 16 is configured to provide an air gap G1 for circulating air and promoting combustion while readily delivering gaseous vapor, under the influence of an inhaled force by a user, through intake openings 103 provided on the bottom surface of the pipe bowl 102, as better illustrated in FIGS. 5 and 7. In one exemplary embodiment, closed bottom 16 may include short, downward, extending feet or nubs for elevating the rock insert 10 upwards from the bottom surface of the bowl opening 104 to increase the size of the air gap G1 thereby increasing and enhancing the circulation of air, and smoke and/or vapor gases created when heating the smokable or vaping material.

Figure 3:
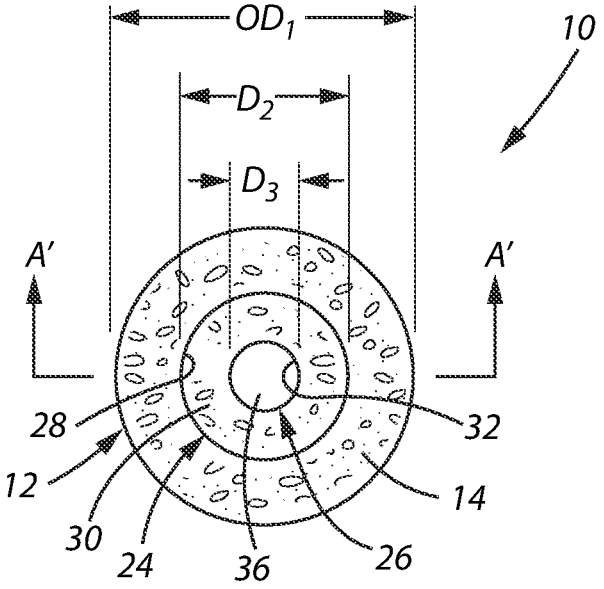
FIG. 3 is a top view of the rock insert of FIG. 1, showing the top opening of the hollow interior including a first interior region in communication with a second interior region adjoined to the closed bottom, the first interior region including a first diameter, and the second interior region including a second diameter that is smaller than the first diameter.
Figure 4:
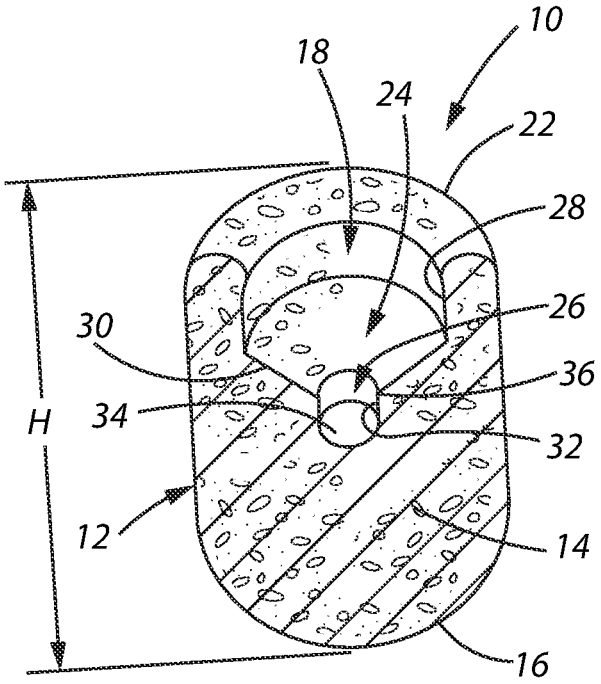
FIG. 4 is a perspective, cross-sectional view of the rock insert of FIG. 1 taken along lines A'-A' in FIG. 3, showing the first interior region including a first sidewall integral with a base, and the second interior region extending through the base defining a second sidewall and a closed base.

Turning now to FIGS. 3 and 4, there are shown a top view, and a perspective, cross-sectional view taken along the lines A'-A' of FIG. 3, respectively, of rock insert 10, in accordance with one embodiment of the present invention. As described, rock insert 10 includes a hollow interior 18 extending partially within the porous body 12 defining a first interior or cavity region 24 in communication with a second interior or cavity region 26. The first interior region 24 extends within the general, central area of the porous body 12 defining a first interior sidewall 28 integral with an annular base 30. The second interior region 26 extends through the annular base 30 and further into the porous body 12 defining a second sidewall 32 including a perimeter having a rim, an edge or sharp edge 36, and a closed base 34. In one exemplary embodiment, the first interior region 24 and the second interior region 26 comprise an annular or circular ledge 30 between them. In one exemplary embodiment, the first interior sidewall 28 comprises a generally vertical sidewall that is integral with a sloping or angled annular base or ledge 30. The sloping configuration of the annular base 30 helps retain the smokable or vaping material within the second interior region 26, and directs heat towards the smokable or vaping material as well. It is understood that the first interior sidewall 28 and/or the annular base or ledge 30 may comprise a same or different angle, or slope. For example, the first interior sidewall 28 and/or annular base 30 may comprise the same or a different angle, slope, orientation, configuration, or dimension, such as, for example, angled, beveled, diverging, converging, sloped, curved, planar, bulging, protruding, or including a convex and/or concave shape or comprise any combination thereof. In other embodiments, the first and second interior regions are not physically separated by an annular base or ledge 30, forming a continuous gradient from the top perimeter 22 to the closed base 34. For example, in one embodiment, there is a bump at the intersection between the first and second interior regions and in another embodiment, there is no change in the angle, slope, orientation, configuration, or dimension between the first and second interior regions where the first and second region include an integral sidewall to form a single interior.

In practice, rock insert or heating rock 10 is shaped and sized for compatible use with a variety of smoking or vaping paraphernalia. For instance, in one non-limiting example, rock insert 10 is adapted for use with a smoking pipe 100 that generally includes a circular pipe bowl 102 having a bowl opening 104 for accommodating a smokable or vaping material. The rock insert 10 is generally shaped to complement the shape of the bowl opening 104 of a smoking pipe 100. As noted, because smoking pipes may have differently sized bowl openings 104, the rock insert 10 may comprise a host of different sizes and shapes to accommodate different types of smoking pipes, or other smoking and/or vaping paraphernalia having designated ports, openings, or recesses of different sizes or shapes. In one exemplary embodiment, and as referenced in FIGS. 3 and 4, rock insert 10 includes a cylindrical porous body 12 having an outer diameter OD1 of 5 to 10 cm, with a preferred diameter of approximately 7 cm, and an overall height, denoted at H in FIG. 4, of 7 to 12 cm, with a preferred height of approximately 8 cm. The first interior region 24 may include a diameter denoted at D2 of 2 to 7 cm, with a preferred diameter D2 of approximately 4 cm, and a depth of 1 to 3 cm. The second interior region 26 may include a diameter denoted at D3 of 1 to 3 cm, with a preferred diameter D3 of approximately 2 cm, and a depth of 2 to 4 cm. It is noted that for exemplary purposes, the second interior region 26 has a smaller diameter than the diameter of the first interior region 24. The second interior region 26 is configured to receive smokable or vaping material therein in the form of a solid, semi-solid material, or a liquid concentrate. The second interior region 26 shelters smokable or vaping material from direct exposure to an open flame produced from an external heat source, such as a torch, match, or butane lighter. In circumstances where a solid or semi-solid concentrate material is employed, the porous body 12 absorbs heat produced by an external heating source, and gradually delivers the heat to the solid or semi-solid material to liquefy the concentrate to produce a gaseous vapor for human consumption. The porous structure of the second interior region 26 effectively absorbs and retains the liquefied concentrate or agent as it's being heated. The small diameter of the second interior region 26 provides a narrow, shallow area for concentrate material to accumulate and absorb heat from the surrounding, porous structure of the body 12.

In another constructive embodiment, the first interior region 24 may include a diameter that is approximately 30% of the outside diameter OD1 of the porous body 12 of the rock insert 10. The depth of the first interior region 24 is approximately 10% of the total overall height H of the rock insert 10. The second interior region 26 is approximately 30% the diameter of the first interior region 24, and extends downwards approximately 20% of the total height H of the porous body 12 of the rock insert 10. It is understood that the rock insert 10 may be constructed from a natural resource, or a man-made resource using any number of tools, machines, or processes.

Turning now to FIGS. 5 and 6, there are shown a perspective view of the rock insert 10 readily adapted for use with a traditional smoking paraphernalia comprising, in one example, a smoking pipe 100. The traditional construction of a smoke pipe 100 typically includes a circular pipe bowl 102 including a bowl opening 103 having a plurality of intake openings 104 formed within the base 107 of the bowl opening 103, and a stem 106 conjoined to the pipe bowl 102. The stem 106 includes a gas delivery channel 108 (shown in dotted lines) that extends along an inner, central axis of the stem 106 and terminates at a mouthpiece 110 provided at a distal end of the stem 106. The gas delivery channel 108 is in fluid communication with one or more intake openings 104 provided within the bowl opening 103. Gaseous smoke and/or vapor produced when heating a smokable or vaping material, flows within the intake openings 104 and passes through the gas delivery channel 108 and out from mouthpiece 110 under inhaled force of a user.

In one embodiment, rock insert or heating rock 10 is shaped and sized to correspondingly fit within the bowl opening 103 of the pipe bowl 102 under friction where the outer surface of sidewall 14 of the porous body 12 engages the inner surface of the bowl opening 103 preventing the rock insert 10 from easily falling out of the pipe bowl 102 during use. In one non-limiting embodiment, the porous body 12 may include engaging features formed integral with, or separately attached to, the outer surface of the sidewall 14 to help removably retain the rock insert 10 securely within the bowl opening 103. For example, such engaging features may include any of, embossed spirals, ridges, protrusions, or nubs, or one or more bands or O-rings provided on the outer surface of sidewall 14 of the porous body 12. Types of material used for the engaging features may include fire and/or heat resistant metal, rubber, silicone, volcanic material, glass, ceramic, or fabric. For example, in one non-limiting embodiment, the rock insert 10 can include an o-ring formed integral with, or provided separately on, the outer surface of the sidewall 14 of the porous body 12 so that when the rock insert 10 is fully disposed within the bowl opening 103, the o-ring engages the inner surface of the bowl opening 104 securing the rock insert 10 in place.

Figure 7:
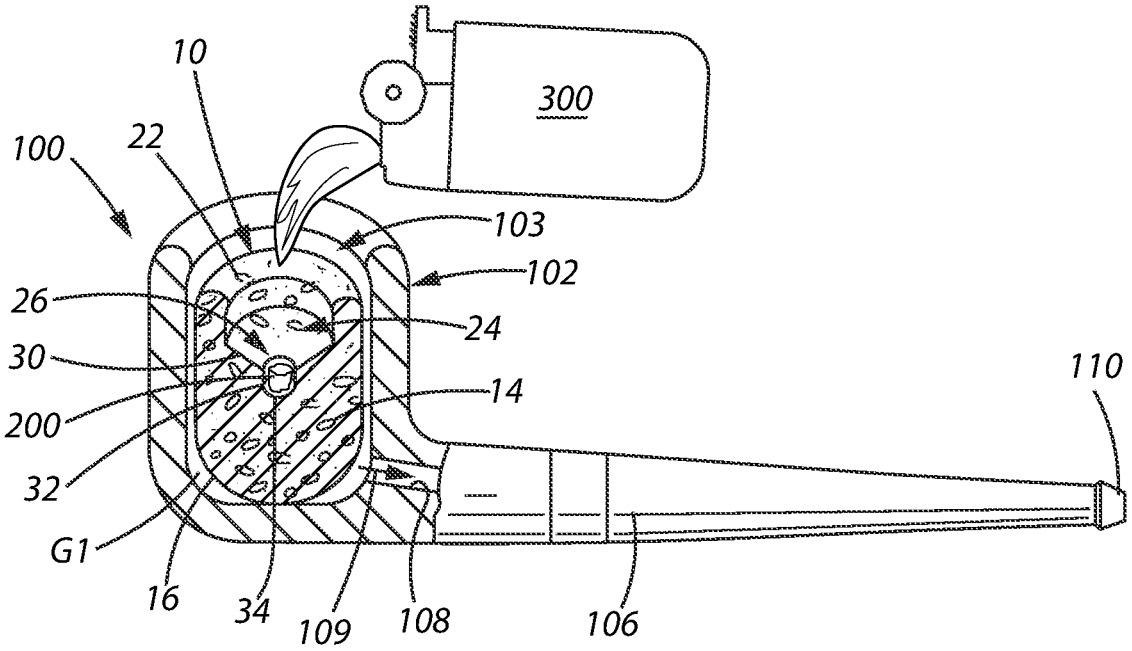
FIG. 7 is a perspective, cross-sectional view of the rock insert seated within the pipe bowl taken along lines B'-B' of FIG. 6, showing an open flame directed towards the upper region of the rock insert allowing the porous body to absorb heat to gradually heat smokable or vaping material provided within the hollow interior of the porous body producing a gaseous vapor delivered through the stem of the smoking pipe for inhaled consumption by users.

With reference to FIG. 7, there is illustrated a side view of the smoke pipe 100 showing a perspective, cross-sectional view of the rock insert 10 fully seated within the pipe bowl 102 taken along lines B'-B' of FIG. 6. For illustrative purposes, a smokable or vaping material comprising a solid, semi-solid, or liquid concentrate material, generally denoted at 200, is deposited within the hollow interior 18 of the porous body 12 such that a portion of the deposited smokable material is received within the second interior region 26. The angled annular base 30 helps direct the smokable material towards entry of the second interior region 26. The second interior sidewall 32 and closed base 34, as illustrated in FIG. 4, help secure and retain the concentrate material 200 within the second interior region 26. In practice, an external heating source 300 is used to heat the porous body 12. In the representative example, the external heating source 300 comprises a butane lighter, however, other devices such as an electric heater, a match, candle, or a portable, hand-operated butane torch can be used. The butane lighter 300 is manipulated by a user to direct the open flame towards the upper region of the porous body 12 including the top perimeter 22, and an upper area of the first interior region 24 allowing the porous body 12 to absorb heat. The heat produced is captured within the multitude of pores vesicles formed within the porous body 12. The absorbed heat accumulates within the surrounding area and inwards of the second interior region 36 gradually heating the smokable or vaping material while preventing direct exposure to the open flame. The porous structure of the body 12 or rock insert 10 provides a flame-resistant substrate that effectively absorbs heat, and delivers heat gradually to the smokable or vaping material 200 slowly in a controlled manner allowing the smokable or vaping material 200 to change states from a solid or semi-solid phase into a liquid concentrate. As the solid or semi-solid material 200 changes into a liquid concentrate, the liquid concentrate flows within the plurality of interconnected pores, crevices, pockets, vesicles, and grain boundaries of the porous structure of the rock insert 10 while absorbing heat evenly and slowly. As the flame from the lighter 300 is extinguished or removed, the liquid concentrate material 200 continues to absorb heat provided by the porous body 12. As the temperature continues to rise, the liquid concentrate material lodged in the plurality of interconnected pores, crevices, pockets, vesicles, and grain boundaries changes from a liquid state into a gaseous state releasing a gaseous vapor. The gaseous vapor passed through the intake openings 104 provided at the bottom surface 107 of the pipe bowl 102, and flows 109 through delivery channel 108 of stem 106, and out from mouthpiece 110 under inhaled force by a user for enjoyed consumption. As such, the solid or semi-solid material 200 is heated to a liquid concentrate, and then subsequently to a gaseous vapor in the presence and absence of a direct flame produced from an external heating source. The porous structure of the body 12 provides a flame-resistant substrate that regulates the heat applied from the exposed flame, and allows the solid or semi-solid material 200 to change into a liquid concentrate and gaseous vapor without burning quickly. As some smokable or vaping materials, concentrates, or agents are sensitive to heat, continuously applying a direct flame would vaporize the heat sensitive liquefied concentrate too quickly compromising the ability to generate gaseous vapor. It is noted that users may employ a smokable or vaping material that comprises a liquid concentrate thus eliminating the need to transform a solid or semi-solid material into a liquid state.

Figure 8:
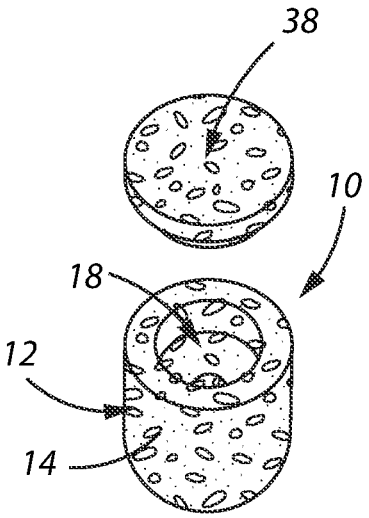
FIG. 8 is a perspective view of the rock insert of FIG. 1, showing a cap removably attachable to the top opening of the porous body for shielding smokable or vaping material within the interior of the rock insert.

Turning now to FIG. 8, there is shown a perspective view of the rock insert 10, and a cap 38 removably attachable to the top opening 20 of the porous body 12 for shielding smokable or vaping material deposited within the hollow interior 18 of the rock insert, in accordance to an alternative embodiment of the present invention. The cap 38 is employed to shield the smokable or vaping material 200 from direct exposure of an open flame generated from an external heating source, and to protect the material from exposure. In a preferred embodiment, cap 38 is constructed from the same porous material used to construct rock insert 10. Cap 38 may include frictional engagement features to help retain the cap 38 to the top opening 20 of the porous body 12. The bottom surface of the cap 38 can be engineered to help direct heat downwards towards the first and second interior regions 24, 26 for heating smokable or vaping material disposed within the hollow interior 18 of the porous body 12. For example, in one, non-limiting example, cap 38 may include a convex-shaped underside that extends within a portion of the first interior region 24 when attached to the top opening 20 of the rock insert 10. The downward convex projection directs heat downwards towards the smoking or vaping material retained within the second interior region 26.

Various changes, alterations, and modifications can be made to the rock insert 10 to improve or enhance performance, or to provide additional advantages of operation and use. For example, rock insert 10 may comprise any color, and density, porosity, and permeability sufficiently necessary to permit a liquid concentrate to enter the porous structure and absorb heat gradually to change the liquid concentrate from a liquid state into a gaseous vapor in a controlled manner for human inhaled consumption. It is understood that the size, shape, configuration, and dimensions OD1, D2, D3, H of the body 12 or rock insert or heating rock 10 may be altered, modified, or changed to accommodate use of the rock insert 10 with various traditional and/or specifically designed smoking and/or vaping paraphernalia. The overall height H of the porous body 12 may be slightly increased to extend slightly higher than the surrounding upper perimeter or rim of the pipe bowl 102 to provide an area for users to grasp the rock insert 10 with their fingers when inserting and removing the rock insert 10 from a designated paraphernalia recess, opening or bowl. In addition, it is understood that although the rock insert 10 is shown to include a cylindrical porous body 12, it is understood that the porous body 12 may comprise other geometric shapes, sizes, and configurations to accommodate use with various smoking pipes, and vaping devices. As such, the porous body 12 may comprise any of an oblong, oval, ellipse, square, rectangular, or semi-circular shape.

Figure 9:
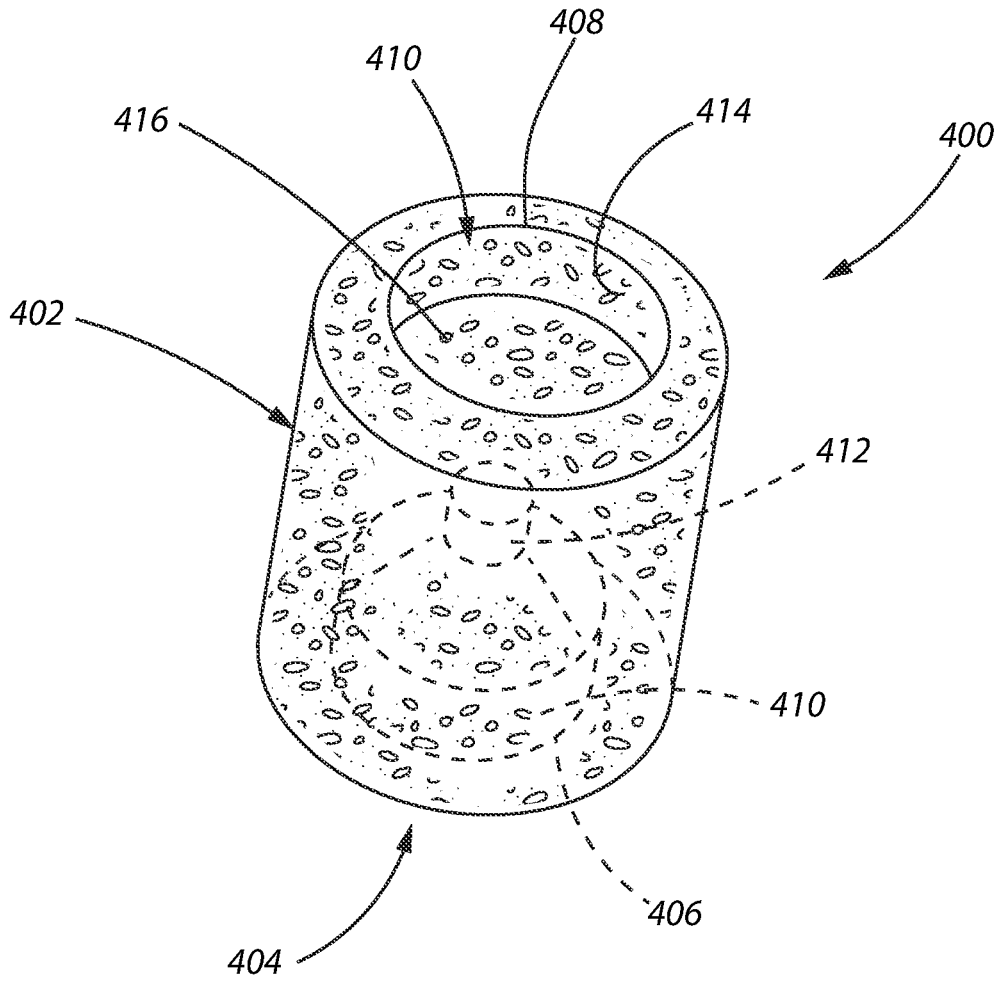
FIG. 9 is a bottom, perspective view of a rock insert showing a porous body including a hollow interior extending within the porous body for holding a smokable or vaping material, a top opening in communication with the hollow interior, and a bottom, and an alternate interior formed within the bottom for holding smokable or vaping material, in accordance with an alternative embodiment of the present invention.

In reference to FIG. 9, there is illustrated a perspective view of a rock insert 400 showing a circular or cylindrical porous body 402 including a hollow interior 404 extending within one end of the porous body 402 for receiving a smokable or vaping material, a top opening 406 in communication with the interior 404, a bottom 408, and an alternate interior 410 formed within the bottom 408, opposite hollow interior 404, in accordance with an alternative embodiment of the present invention. Rock insert or heating rock 400 is similar in construction and operation to rock insert 10 with the exception of the inclusion of an alternate interior 410 formed at the opposite end of interior 404. As described, rock insert 400 includes a hollow interior 404 extending within the cylindrical porous body 402 and including a first interior region 410 in communication with a second interior region 412 similar to interior regions 24, 26 of porous body 12. An alternate interior 410 is formed within bottom 408 of the porous body 402 defining an alternate sidewall 414 integral with an alternate closed base 416. The alternate interior 410 may include a single interior or in one embodiment, include an alternate first and second interior region (not shown) similar to the first and second interior regions 24, 26 of porous body 12 of rock insert 10. The alternate interior 410 may comprise any diameter, depth, and shape. Rock insert or heating rock 400 provides multiple interiors 404, 410 to accommodate use with a variety of different smokable or vaping materials. In practice, users can removably insert the rock insert 400 into a pipe bowl 102 of a smoking pipe 100 to expose hollow interior 404 for use with a certain type of smokable or vaping material, or alternatively, users can invert and reposition the rock insert 400 into the pipe bowl 102 to expose the alternate interior 410 to accommodate use with a different type of smokable or vaping material.

Figure 10:
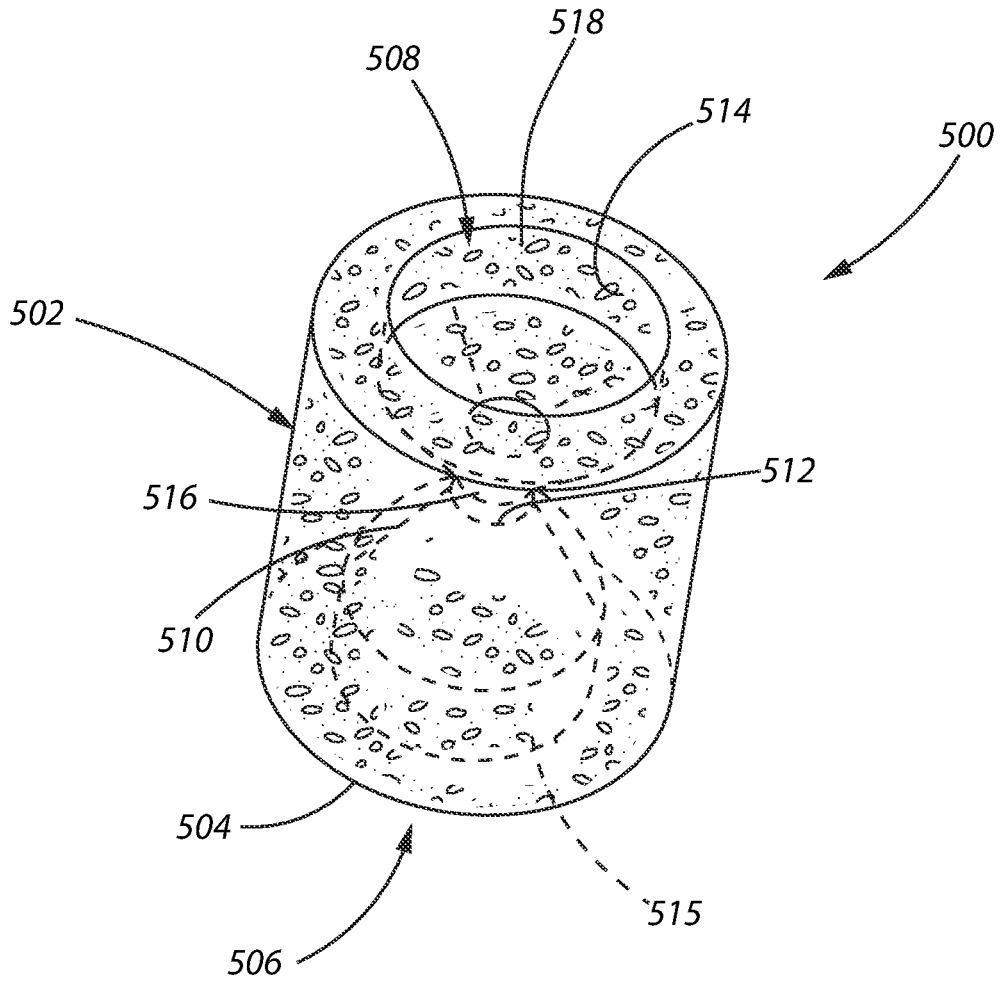
FIG. 10 is a side, perspective view of a rock insert showing a porous body including a first interior formed in one end of the porous body, and a second interior formed in an opposite end of the porous body, each first and second interior adapted for holding smokable or vaping material, in accordance with another embodiment of the present invention.

There is shown in FIG. 10, a side, perspective view of a rock insert 500 including a porous body 502 having a first hollow interior 506 formed in one end 504, and a second hollow interior 508 formed in another end, opposite the one end 504, in accordance with an alternative embodiment of the present invention. The porous body 502 may comprise any shape and size, but in a preferred embodiment, comprises a cylindrical shape. The first hollow interior 506 extends within a general, central area of one end 504 of the porous body 502 defining a first interior sidewall 510 integral with a first closed base 512, and a first opening 514. The second hollow interior 508 extends within a general, central area of another end of the porous body 502, opposite the one end 504, defining a second interior sidewall 515 integral with a second closed base 516, and a second opening 518. In one embodiment, the first and second sidewall 510, 515 may each taper inwards, or extend vertically when extending from respective closed base 512, 516 towards openings 514, and 518. Alternatively, the first sidewall 510 may taper inwards, while the second sidewall 515 extends vertically as the sidewalls 510, 515 extend respectively from each closed base 512, 516 towards openings 514, 518, or vice-versa. It is noted that each closed base 512, 516 is distinctly separated apart from each other a predefined distance. The first and second hollow interior 506, 508 may each comprise the same or different dimension, size and/or shape. For example, in one embodiment, the first hollow interior 506 may be equal in dimension, size, and/or shape to that of the second hollow interior 508 where each hollow interior 506, 608 holds the same amount of smokable and/or vaping material therein. In yet another embodiment, the first hollow interior 506 may comprise a smaller depth than that of the second hollow interior 508. It is understood that inclusion of the first and second hollow interior 506, 508 provides a functional benefit. For example, as the rock insert or heating rock 500 is used over time, any excess smokable or vaping materials, such as resin or liquid concentrate, that flows downwards towards the bottom end of the rock insert 500 when retained within a designated opening or recess of a smoking or vaping paraphernalia becomes accessible when the rock 500 is inverted for use. Any lingering resin or liquid concentrate that flowed towards the bottom is simply reheated to produce a gaseous vapor for inhaled consumption.

Figure 11:
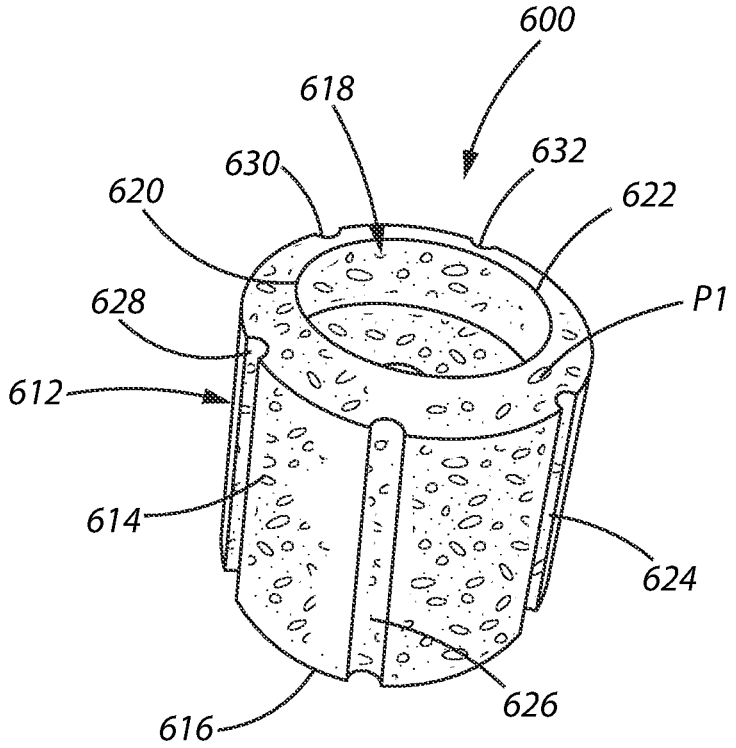
FIG. 11 is a top, perspective view of a heating rock including a porous body having a hollow interior extending within the porous body for holding a smokable or vaping material therein, a top opening in communication with the hollow interior, a closed bottom, and at least two channels formed within, and extending along a surrounding sidewall of the porous body, in accordance with one alternative embodiment of the present invention.
Figure 12:
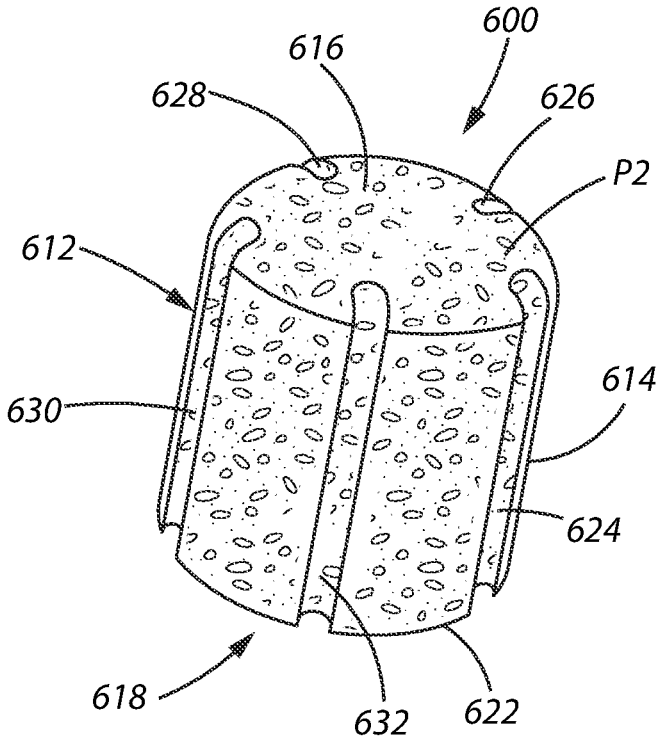
FIG. 12 is a bottom, perspective view of the heating rock of FIG. 11, showing the porous body including the closed bottom having a conical contour, and distal ends of the at least two channels extending further along the outer surface of the closed bottom.

Turning now to FIGS. 11, and 12 there are shown a top and a bottom, perspective view, respectively, of a rock insert or a heating rock 600, in accordance with an alternative embodiment of the present invention. Heating rock 600 includes a porous body 612 having a surrounding sidewall 614, a hollow interior or cavity 618 that extends partially within a central region of the porous body 612 defining a top opening 620 having a top perimeter 622, and a closed bottom 616 integral with the surrounding sidewall 614. In one embodiment, heating rock 600, and more particularly the porous body 612 comprises a cylindrical or circular, geometric shape to accommodate use with the round shape of a pipe bowl of a smoking pipe. The closed bottom 616 includes a conical contour or configuration, though the closed bottom 616 may be flat. Heating rock 600 is formed and constructed from earth's natural resource material such as volcanic lava, extrusive and/or igneous substance or materials having a porous structure including a plurality of minute spaces, holes, pores, crevices, pockets, vesicles, cavities, and/or grain boundaries shown generally, for illustrative purposes, at P1, and P2. The porous body 612 includes heat resistance properties that provide natural heat insulation properties which effectively absorbs heat, and evenly distributes heat when heated by an external heat source such as an open flame. The porous structure of the body 612 continues to deliver heat gradually over a prescribed period of time even after an external heat source is extinguished or removed. The porous body 612 is constructed from various types of materials including for example, but not limited to, volcanic rock or lava, extrusive and/or igneous materials, basalt, andesite, rhyolite, dacite, latite, pumice, pyroclastic rock, sandstone, siltstone, mudstone, shale, granite, Trachytic obsidian, Trachyte, Andesitic glass, Syenite, Granodiorite, Quartz diorite, Rhyolitic obsidian, various tuffite, clay, glass, fire rock, limestone, or any combination thereof. Red lava rock, technically called "scoria" provides a colorful addition to the rock 600 and comprises vesicular basaltic lava having very small pores or vesicles (<1 mm). Grey lava rock often referred to as "pumice" typically includes subtle layering of a volcanic glassy nature that comprises a mixture of rock and volcanic ash and includes an abundance of air thus being extremely light in weight. Red lava rock is generally denser in nature as it has less air infused into the rock as compared to pumice. In a preferred embodiment, the heating rock 600 is constructed using the more dense red lava rock.

Heating rock 600 is similar in construction and function to rock insert 10 or 400 with the exception of added channels 624, 626, 628, 630, 632 that are designed to promote airflow, enhance air circulation about the porous body 612, and to improve combustion of the smoking or vaping material when stored within the hollow interior 618 when the heating rock 600 is inserted within a pipe bowl 102 of a pipe 100, as illustrated in FIGS. 5 and 6. In one exemplary embodiment, each channel 626, 626, 628, 630, 632 is partially formed within the porous body 612 extending from the closed bottom 616 upwards towards the top opening 618 within the surrounding, sidewall 614, each channel includes a distal end situated about the closed bottom 616, and a proximate end terminating near the top opening 618 or the top perimeter 622. Each channel 624, 626, 628, 630, 632 may comprise the same or different width, and depth. For example, in one exemplary embodiment, each channel 624, 626, 628, 630, 632 comprises a width from 1 to 10 mm. A first set of channels may comprise a first width, and a second set of channels comprise a second width different from the first width. In practice, the channels 624, 626, 628, 630, 632 are spaced apart from each other at a same or different distance around the circumference of the porous body 612. In one non-limiting example, each channel is spaced apart from each other from 3 to 8 mm. The channels 624, 626, 628, 630, 632 are formed using any well-known machining process, technique, or etching method.

As illustrated in FIG. 12, in one exemplary embodiment, the distal end of each channel 624, 626, 628, 630, 632 extends partially along the outer surface of the closed bottom 616 a predefined distance to further encourage air circulation along the closed bottom 616 when the heating rock 600 is removeably inserted within the bowl opening 103 of pipe bowl 102 of smoking pipe 100. It is appreciated that in one alternative embodiment, the distal end of each channel 624, 626, 628, 630, 632 may terminate directly at the peripheral edge of the closed bottom 616 without extending further along the outer surface of the closed bottom 616. As shown, channels 624, 626, 628, 630, 632 are formed such that each channel comprises a semi-circular formation or groove that is partially etched within the surrounding sidewall 614 of porous body 612.

Figure 13:
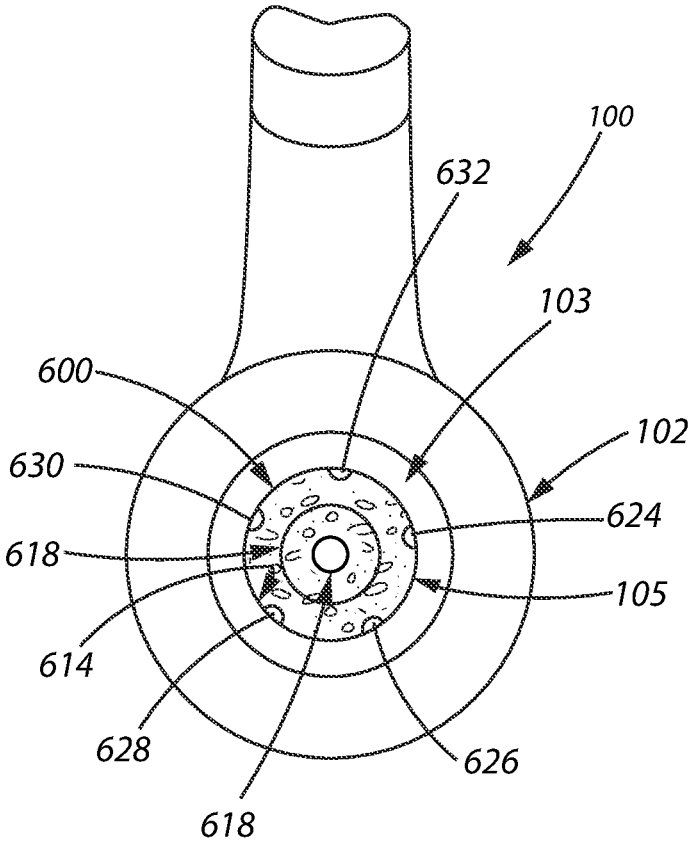
FIG. 13 is top view of the heating rock of FIG. 11 fully inserted within a bowl opening of a smoking pipe, showing the hollow interior of the heating rock for holding smoking or vaping material therein, and air openings defined by the channels allowing air to circulate about the porous body of the heating rock.

As shown in FIG. 13, in use, heating rock 600 is fully inserted within the bowl opening 103 of the pipe bowl 102 of a smoking pipe 100. Each channel 624, 626, 628, 630, 632 is situated such that they directly face the inner surface 105 of the bowl opening 103 forming air channels or openings allowing air to flow between the inner surfaces of each channel, and the inner surface of pipe bowl 103. It is noted that channels 624, 626, 628, 630, 632 having a greater width and/or depth will provide for a larger space and for a larger amount of air to flow and circulate therebetween. Further, since distal ends of each channel 624, 626, 628, 630, 632 directly face the bottom surface of base 107 of pipe bowl 102, air also flows along the closed bottom surface 616 of the porous body 612 of heating rock 600 enhancing combustion of the smoking or vaping material.

Figure 14:
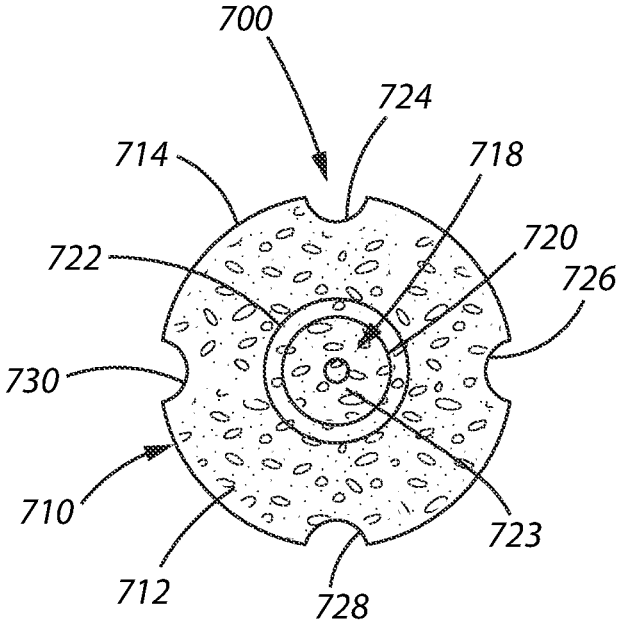
FIGS. 14 and 15 is a top, and a perspective view, respectively, of a heating rock including a porous body having a geometric, disc shape, and including a top surface, a bottom surface, a surrounding sidewall integral with the top and bottom surfaces, a hollow interior extending within the porous body for holding a smokable or vaping material therein, a top opening in communication with the hollow interior, a closed bottom, and at least two channels formed within, and extending between the bottom surface, and the top surface of said porous body, in accordance with another embodiment of the present invention.
Figure 15:
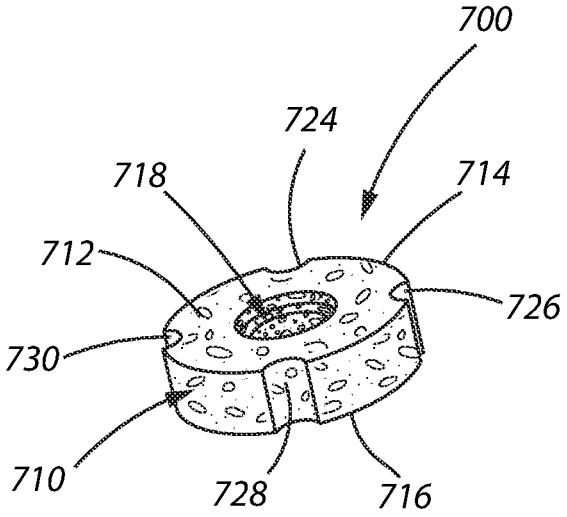

Turning now to FIGS. 14 and 15, there are shown a top, and a perspective view, respectively, of a heating rock 700, in accordance with another embodiment. Heating rock 700 includes a porous body 710 comprising a geometric, disc shape having a top surface 712 integral with a surrounding sidewall 714, and a bottom surface 716 opposite the top surface 712. Heating rock 712 is tailored to accommodate use with smoking pipes that have a smaller, or shallower pipe bowl 102. In one embodiment, the top surface 712 comprises a slightly concave configuration or contour, and the bottom surface 716 comprises a flat surface, or a conical contour. Heating rock 700 further includes a cavity or hollow interior 718 that extends within the central region of the porous body 710 defining a top opening 720 having a top perimeter 722, and a closed bottom 723. The hollow interior 718 is sized to accommodate holding a smokable or vaping material, such as tobacco, therein.

Heating rock 700 further includes a plurality of channels 724, 726, 728, 730 designed to promote airflow, enhance air circulation about the porous body 710, and to improve combustion of the smoking or vaping material when stored within the hollow interior 718 when the heating rock 700 is inserted within a pipe bowl 102 of a pipe 100, as illustrated in the exemplary embodiments of FIGS. 5 and 6. Each channel 724, 726, 728, 730 is partially formed within the outer surface of the surrounding sidewall 714 of porous body 710, and extends between the top surface 712, and the bottom surface 716. Each channel 724, 726, 728, 730 may comprise a same or different width, and depth, and are generally spaced apart from each other at a same or different distance around the circumference of the porous body 710. In one non-limiting example, each channel is spaced apart from each other at a same distance. As shown, similar to channels 624, 626, 628, 630, 632, each channel 724, 726, 728, 730 comprises grooves having a semi-circular formation partially etched or formed within the surrounding sidewall 714 of the porous body 710. In one embodiment, heating rock 700 may comprise a diameter of ½ inch, and a thickness of 3/16 inch, though other sizes and dimensions may be contemplated. In one embodiment, each channel 724, 726, 728, 730 may extend further along the bottom surface 716, and/or top surface 712, respectively, a predefined distance.

Various modifications can be made to heating rocks 600, and 700 without departing from the scope of the invention. For example, a drilling method may be employed to form channels 624, 626, 628, 630, 632, and 724, 726, 728, 730 that extend vertically, horizontally, or diagonally, or any combination thereof. Further, rock inserts 10, 400, and heating rocks 600, 700 may comprise any geometric shape including for example, a cube, cuboid, cylinder, disc, octagon, pentagon, or trapezoid, or square shape or configuration, and may also comprise any size or dimension to accommodate use with smoking pipes, or vaping devices of differing sizes, styles, or configurations.

Since many modifications, variations, and changes in detail can be made to the described preferred embodiments of the invention, it is intended that all matters in the foregoing description and shown in the accompanying drawings be interpreted as illustrative and not deemed to be limiting. Furthermore, it is understood that any of the features presented in the embodiments may be integrated into any of the other embodiments unless explicitly stated otherwise. The scope of the invention should be determined by the appended claims and their legal equivalents. Modifications, additions, or omissions may be made to the systems, apparatuses, and methods described herein without departing from the scope of the disclosure. For example, the components of the system may be integrated together, or separated. Moreover, the operations of the systems and apparatuses disclosed herein may be performed by more, fewer, or other components and the methods described may include more, fewer, or other steps.

What is claimed is:

1. A smoking or vaping accessory comprising:

a removable rock insert comprising a porous body including a surrounding sidewall, a hollow interior extending partially within a central region of said porous body defining a top opening in communication with said hollow interior, and a closed bottom, said hollow interior including a first interior region having a first interior sidewall integral with an annular base, and a second interior region extending through said annular base defining a second interior sidewall integral with a closed base, said first interior region comprising a first diameter, and said second interior region comprising a second diameter, said second diameter being smaller than said first diameter; at least two channels each formed within an outer surface of said surrounding sidewall and said closed bottom of said porous body, and extending from a portion of said closed bottom and terminating adjacent said top opening, each of said at least two channels having a width and a depth, and spaced a predetermined distance apart from each other, circumferentially around said porous body; and wherein said rock insert is removably seated within a designated recess of a smoking pipe or vaping device where said porous body is heated by a heating source to gradually distribute heat to a smokable or vaping material disposed within said hollow interior of said removable rock insert to produce a gaseous vapor for human consumption, each of said at least two channels allowing both air and smoke generated by heating said smoking or vaping material to flow between an inner surface of said designated recess, and said outer surface of said surrounding wall of said porous body, and wherein said removable rock insert is removably retained within said designated recess by friction.

2. The smoking or vaping accessory of claim 1, wherein said rock insert comprises said porous body comprising any of a cylindrical shape, and a disc shape, said porous body further comprising a microporous, macroporous, cryptoporous, ultramicroporous, or mesoporous material.

3. The smoking or vaping accessory of claim 2, wherein said removable rock insert comprises said porous body that includes any of volcanic rock, lava, scoria, basalt, andesite, rhyolite, dacite, latite, pumice, pyroclastic rock, sandstone, siltstone, mudstone, shale, granite, Trachytic obsidian, Trachyte, Andesitic glass, Syenite, Granodiorite, Quartz diorite, Rhyolitic obsidian, various tuffite, clay, glass, firerock, limestone, or any combination thereof.

4. The smoking or vaping accessory of claim 3, wherein said removable rock insert comprises a porous body that includes said closed bottom having a rounded shape to accommodate a concave contour of an inner bottom of said designated recess when said removable rock insert is seated within said designated recess.

5. The smoking or vaping accessory of claim 3, further including an alternate hollow interior extending partially within said closed bottom of said porous body of said removable rock insert defining an alternate top opening, and an alternate sidewall integral with an alternate closed base, said alternate hollow interior formed opposite said hollow interior such that said alternate closed base is parallel with said closed base.

6. The smoking or vaping accessory of claim 3, wherein said at least two channels comprises at least four channels each formed within said outer surface of said surrounding wall and said closed bottom of said porous body, each of said at least four channels extending from a portion of said closed bottom of said porous body and terminating adjacent said top opening, each of said channels having a width and depth, and spaced a predetermined distance apart from each other circumferentially around said porous body, each of said at least four channels allowing both air and smoke generated by heating said smoking or vaping material to flow between said inner surface of said designated recess, and said outer surface of said surrounding wall of said porous body.

7. The smoking or vaping accessory of claim 3, wherein said second interior region defines an interior opening having a perimeter formed within said annular base, said annular base angled to direct movement of said smoking or vaping material into said interior opening of said second interior region when said smoking or vaping material is disposed within said hollow interior.

8. The smoking or vaping accessory of claim 6, wherein said designated recess comprises a pipe bowl opening of a pipe bowl of a smoking pipe.

9. The smoking or vaping accessory of claim 3, wherein said smoking or vaping material comprises any of a compound, a mixture, a blend, an agent, a powder, a solid, a semi-solid, a wax, an oil, a gel, or a liquid that comprises any of, tobacco, nicotine, herbs, mullein, skullcap, coltsfoot, mugwort, uvaursi, mint, sage, California poppy, hops, honeyweed, lavender, lily, passion flower, wireweed, teas, flavored oils, essential oils, hemp, extracts, or *cannabis*.

10. The smoking or vaping accessory of claim 3, wherein said removable rock insert comprises said porous body including said disc shape, said disc-shaped porous body including a top surface having a concave contour for directing said smoking or vaping material into said hollow interior formed in said disc-shaped porous body.

* * * * *